US006453284B1

(12) United States Patent
Paschall

(10) Patent No.: US 6,453,284 B1
(45) Date of Patent: Sep. 17, 2002

(54) MULTIPLE VOICE TRACKING SYSTEM AND METHOD

(75) Inventor: D. Dwayne Paschall, Lubbock, TX (US)

(73) Assignee: Texas Tech University Health Sciences Center, Lubbock, TX (US)

( * ) Notice: Subject to any disclaimer, the term of this patent is extended or adjusted under 35 U.S.C. 154(b) by 0 days.

(21) Appl. No.: 09/360,697

(22) Filed: Jul. 26, 1999

(51) Int. Cl.[7] ..... G10L 11/06

(52) U.S. Cl. ..... 704/208; 704/202; 704/207; 704/206; 381/94.3

(58) Field of Search ..... 381/94.3, 94.7, 381/98, 56, 92; 704/225, 226, 258, 202, 207, 219, 233, 253, 268, 208, 206, 232; 367/118–127

(56) References Cited

U.S. PATENT DOCUMENTS 4,292,469 A * 9/1981 Scott et al. ..... 704/207
4,424,415 A * 1/1984 Lin ..... 704/207
4,922,538 A 5/1990 Tchorzewski
5,093,855 A 3/1992 Vollert et al.
5,175,793 A * 12/1992 Sakamoto et al. ..... 704/200
5,181,256 A * 1/1993 Kamiya ..... 382/14
5,182,765 A 1/1993 Ishii et al.
5,384,833 A 1/1995 Cameron
5,394,475 A 2/1995 Ribic
5,404,422 A * 4/1995 Sakamoto et al. ..... 704/202
5,475,759 A 12/1995 Engebretson
5,521,635 A 5/1996 Mitsuhashi et al.
5,539,806 A 7/1996 Allen et al.
5,581,620 A * 12/1996 Brandstein et al. ..... 381/92
5,604,812 A 2/1997 Meyer
5,636,285 A 6/1997 Sauer
5,712,437 A * 1/1998 Kageyama ..... 84/610
5,737,716 A * 4/1998 Bergstrom et al. ..... 704/202
5,764,779 A 6/1998 Haranishi
5,809,462 A * 9/1998 Nussman ..... 704/232
5,812,970 A * 9/1998 Chan et al. ..... 704/226
5,838,806 A 11/1998 Sigwanz et al.
5,864,807 A * 1/1999 Campbell et al. ..... 704/244
6,006,175 A * 12/1999 Holzrichter ..... 704/208
6,130,949 A * 10/2000 Aoki et al. ..... 381/94.3
6,192,134 B1 * 2/2001 White et al. ..... 381/92

* cited by examiner

*Primary Examiner*—Vijay B. Chawan
(74) *Attorney, Agent, or Firm*—Jones, Tullar & Cooper PC

(57) ABSTRACT

For tracking multiple, simultaneous voices, predicted tracking is used to follow individual voices through time, even when the voices are very similar in fundamental frequency. An acoustic waveform comprised of a group of voices is submitted to a frequency estimator, which may employ an average magnitude difference function (AMDF) calculation to determine the voice fundamental frequencies that are present for each voice. These frequency estimates are then used as input values to a recurrent neural network that tracks each of the frequencies by predicting the current fundamental frequency value for each voice present based on past fundamental frequency values in order to disambiguate any fundamental frequency trajectories that may be converging in frequency.

20 Claims, 4 Drawing Sheets

MULTIPLE VOICE TRACKING SYSTEM AND METHOD

BACKGROUND OF THE INVENTION

The present invention relates to a system and method for tracking individual voices in a group of voices through time so that the spoken message of an individual may be selected and extracted from the sounds of the other competing talker's voices.

When listeners (whether they be human or machine) attempt to identify a single taker's speech sounds that are imbedded in a mixture of sounds spoken by other takers, it is often very difficult to identify the specific sounds produced by the target talker. In this instance, the signal that the listener is trying to identify and the "noise" the listener is trying to ignore have very similar spectral and temporal properties. Thus, simple filtering techniques to remove the noise are not able to remove only the unwanted noise without also removing the intended signal Examples of situations where this poses a significant problem include operation of voice recognition software and hearing aids in noisy environments where multiple voices are present. Both hearing-impaired human listeners and machine speech recognition systems exhibit considerable speech identification difficulty in this type of multi-talker environment. Unfortunately, the only way to improve the speech understanding performance for these listeners is to identify the talker of interest and isolate just this voice from the mixture of competing voices. For stationary sounds, this may be possible. However, fluent speech exhibits rapid changes over relatively short time periods. To separate a single talker's voice from the background mixture, there must therefore exist a mechanism that tracks each individual voice through time so that the unique sounds and properties of that voice may be reconstructed and presented to the listener. While there are currently available several models and mechanisms for speech extraction, none of these systems specifically attempt to put together the speech sounds of each individual talker as they occur through time.

SUMMARY OF THE INVENTION

To solve the foregoing problem, the present invention provides a system and method for tracking each of the individual voices in a multi-talker environment so that any of the individual voices may be selected for additional processing. The solution that has been developed is to estimate the fundamental frequencies of each of the voices present using a conventional analysis method and, then follow the trajectories of each individual voice through time using a neural network prediction technique. The result of this method is a time-series prediction model that is capable of tracking multiple voices through time, even if the pitch trajectories of the voices cross over one another, or appear to merge and then diverge.

In a preferred embodiment of the invention, the acoustic speech waveform comprised of the multiple voices to be identified is first analyzed to identify and estimate the fundamental frequency of each voice present in the waveform. Although this analysis can be carried out by using a frequency domain analysis technique, such as a Fast Fourier Transform (FFT), it is preferable to use a time domain analysis technique to increase processing speed, and decrease complexity and cost of the hardware or software employed to implement the invention. More preferably, the waveform is submitted to an average magnitude difference function (AMDF) calculation which subtracts successive time shifted segments of the waveform from the waveform itself As a person speaks, the amplitude of their voice oscillates at a fundamental frequency. As a result, because the AMDF calculation is subtractive, the pitch period of a particular voice will produce a small value near the frequency period $F_0$ of the voice since the AMDF at that point is effectively subtracting a value from itself After the AMDF is calculated, the $F_0$ of each voice present can then be estimated as the inverse of the AMDF minima.

Once the fundamental frequencies of the individual voices have been identified and estimated, the next step implemented by the system is to track the voices through time. This would be a simple matter if each voice was of a constant pitch, however, the pitch of an individual's voice changes slowly over time as they speak. In addition, when multiple people are simultaneously speaking, it is quite common for the pitches of their voices to cross over each other in frequency as one person's voice pitch is rising, while another's is falling. This makes it extremely difficult to track the individual voices accurately.

To solve this problem, the present invention tracks the voices through use of a recursive neural network that predicts how each voice's pitch will change in the future, based on past behavior. The recursive neural network predicts the $F_0$ value for each voice at the next windowed segment. Because the predicted values are constrained by the frequency values of prior analysis frames, the $F_0$ tracks tend to change smoothly, with no abrupt discontinuities in the trajectories. This follows what is normally observed with natural speech: the $F_0$ contours of natural speech do not change abruptly, but vary smoothly over time. In this manner, the neural network thus predicts the next time value of the $F_0$ for each talker's $F_0$ track.

The output from the neural network thus comprises tracking information for each of the voices present in the analyzed waveform This information can either be stored for future analysis, or can be used directly in real time by any suitable type of voice filtering or separating system for selective processing of the individual speech signals. For example, the system can be implemented in a digital signal processing chip within a hearing aid for selective amplification of an individual's voice. Although the neural network output can be used directly for tracking of the individual voices, the system can also use the AMDF calculation circuit to estimate the $F_0$ for each of the voices, and then use the neural network output to assign each of the AMDF-estimated $F_0$'s to the correct voice.

BRIEF DESCRIPTION OF THE DRAWINGS

The features and advantages of the present invention will become apparent from the following detailed description of a preferred embodiment thereof, taken in conjunction with the accompanying drawings, in which.

DETAILED DESCRIPTION OF A PREFERRED EMBODIMENT

Figure 1:
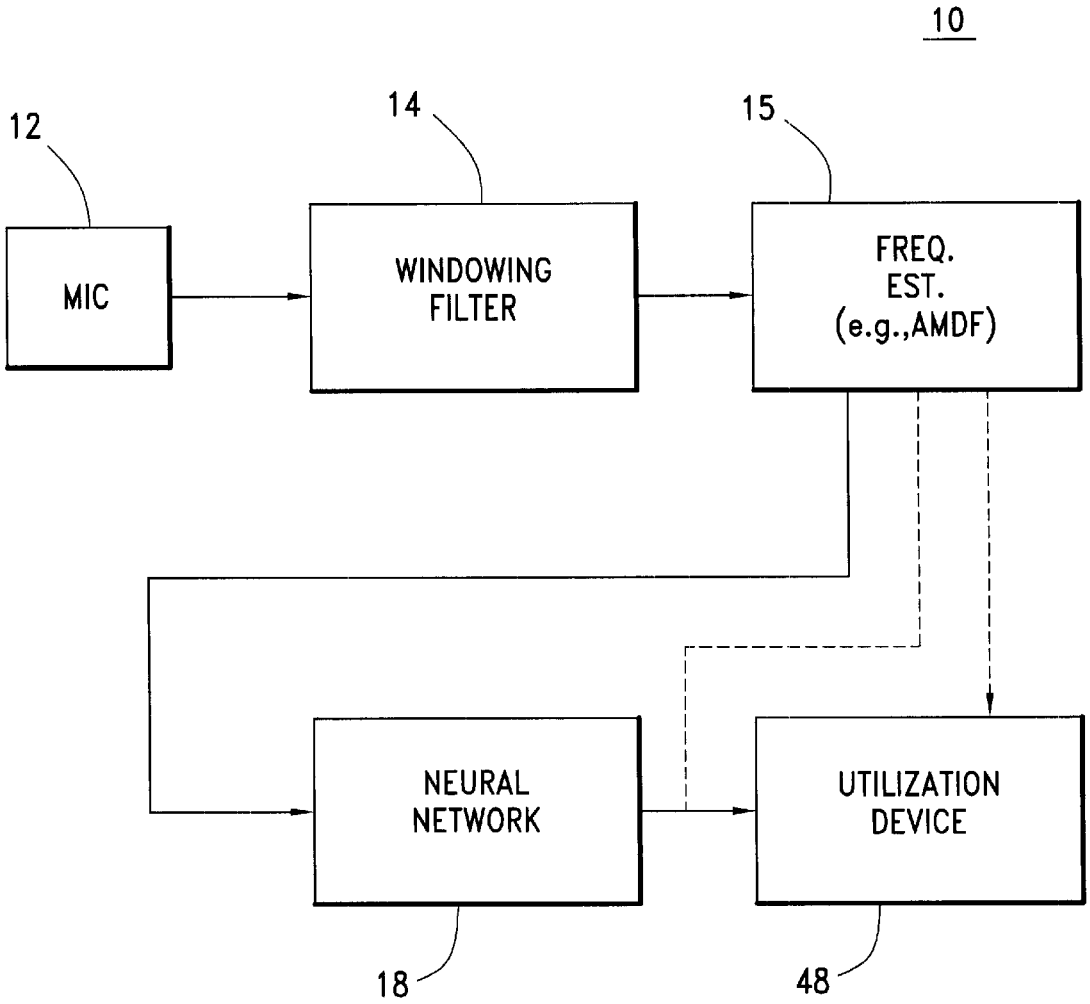
FIG. 1 is a schematic block diagram of a system in accordance with a preferred embodiment of the invention for identifying and tracking individual voices over time.

With reference to FIG. 1, a voice tracking system 10 is illustrated that is constructed in accordance with a first preferred embodiment of the present invention. The tracking system 10 includes the following elements. A microphone 12 generates a time varying acoustic waveform comprised of a group of voices to be identified and tracked. The waveform is initially fed into a windowing filter 14, in which a 15-ms Kaiser window is advanced in 5-ms segments through the waveform to apply onset and offset ramps, and thereby smooth the waveform. This eliminates edge effects that could introduce artifacts which could adversely affect the waveform analysis. It should be noted that although use of the filter 14 is therefore preferred, the invention could also function without the filter 14. Also, although a Kaiser windowing filter is used in the preferred embodiment, any other type of windowing filter could be used as well.

A key feature of the invention is the initial identification of all fundamental frequencies that are present in the waveform using a frequency estimator 15. Although any suitable conventional frequency domain analysis technique, such as an FFT, can be employed for this purpose, the preferred embodiment of the frequency estimator 15 makes use of a time domain analysis technique, specifically an average magnitude difference function (AMDF) calculation, to estimate the fundamental frequencies present in the waveform. Use of the AMDF calculation is preferred because it is faster and less complex than an FFT, for example, and thus makes implementation of the invention in hardware more feasible.

The AMDF calculation is carried out by subtracting a slightly time shifted version of the waveform from itself and determining the location of any minima in the result. Because the AMDF calculation is subtractive, the pitch period of a particular voice will produce a small value near the frequency period of the voice $F_0$. This is because the amplitude of a person's voice oscillates at a fundamental frequency. Thus, a waveform of the person's voice will ideally have the same amplitude at every point in time that is advanced by the pitch period of the fundamental frequency. As a result, if the waveform advanced by the pitch period is subtracted from the initial waveform, the result will be zero under ideal conditions.

The short-time AMDF is defined as:

$$y(k) = \sum_{m=-\infty}^{\infty} |x(n+m)w_1(m) - x(n+m-k)w_2(m-k)|$$

where k is the time amount of the time shift, w is the window function and x is the original signal.

After the AMDF is calculated, the frequency estimator 15 generates an estimate of the $F_0$ of each voice present as the inverse of the AMDF minima.

Figure 2B:
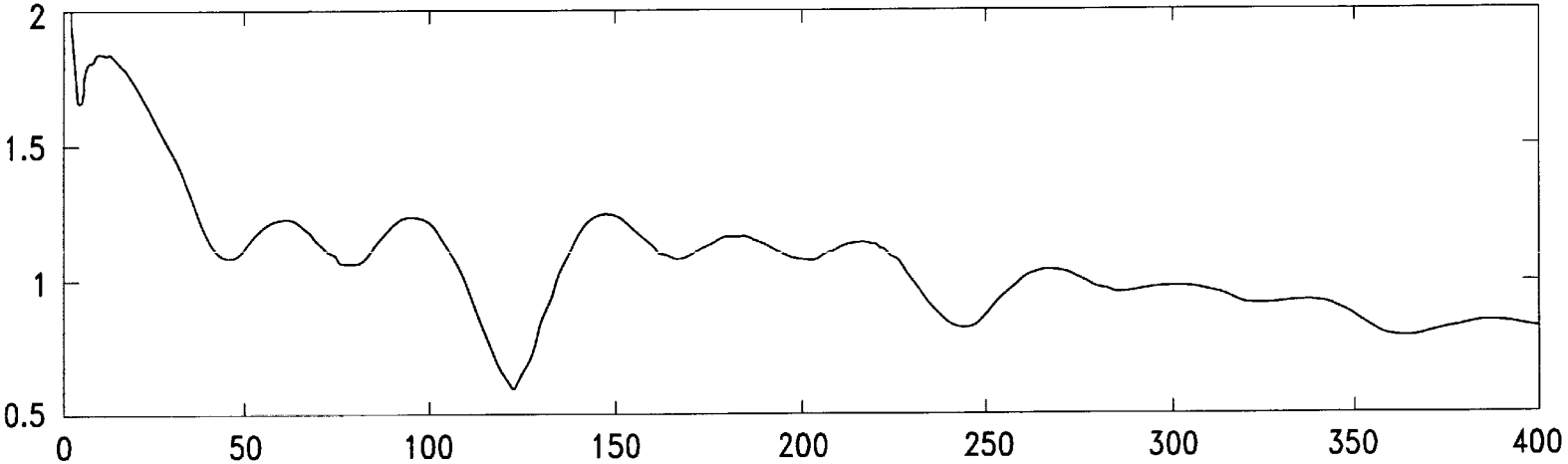
FIG. 2B is an amplitude vs. time graph showing the result of the AMDF calculation of the preferred embodiment on the sample waveform of FIG. 2A.
Figure 2A:
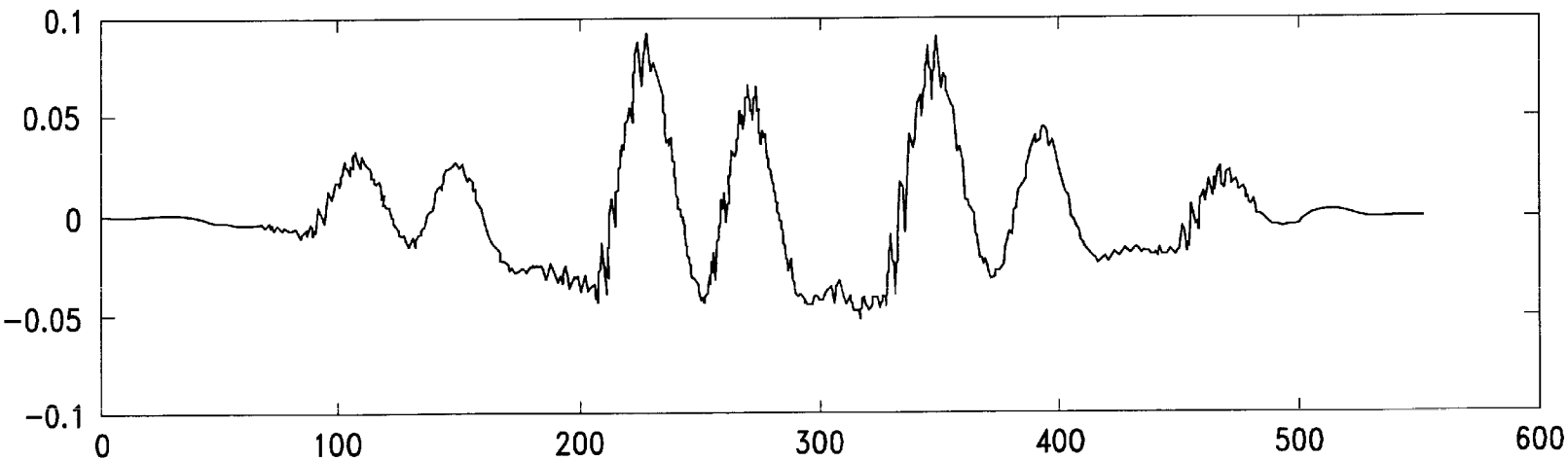
FIG. 2A is a an amplitude vs. time graph of a sample waveform of an individual's voice.

The graphs of FIGS. 2A and 2B illustrate the operation of the the AMDF calculation. The initial waveform illustrated in FIG. 2A shows the amplitude variations of a single individual's voice as a function of time, and is employed only as an example. It will be understood that the invention is specifically designed for identifying and tracking multiple voices simultaneously. The second waveform illustrated in FIG. 2B shows the result of the AMDF calculation as successively time shifted segments of the waveform are subtracted from itself In this example, when the segment being subtracted is shifted in time by approximately 120 msec, a minima occurs that denotes the pitch period of the individuals voice. The inverse of this value is then calculated to determine the fundamental frequency of that individual's voice.

In the foregoing manner, the frequency estimator 15 identifies and generates estimates of each fundamental frequency in the waveform. The frequency estimator 15 cannot, however, generate an estimate of how each of the individuars voices will change over time, since the frequency of each voice is usually not constant. In addition, in multiple talker environments, it is quite common for the frequencies of multiple talkers to cross each other, thus making tracking of their voices virtually impossible with conventional frequency analysis methods. The present invention solves this problem in the following manner.

The output of the frequency estimator 15, i.e., frequency of each fundamental frequency identified, is submitted as the input argument to a recursive neural network 18 that predicts the $F_0$ value for each voice at the next windowed segment. Because the predicted values are constrained by the frequency values of prior analysis frames, the $F_0$ tracks tend to change smoothly, with no abrupt discontinuities in the trajectories. This follows what is normally observed with natural speech: the $F_0$ contours of natural speech do not change abruptly, but vary smoothly over time.

Figure 3:
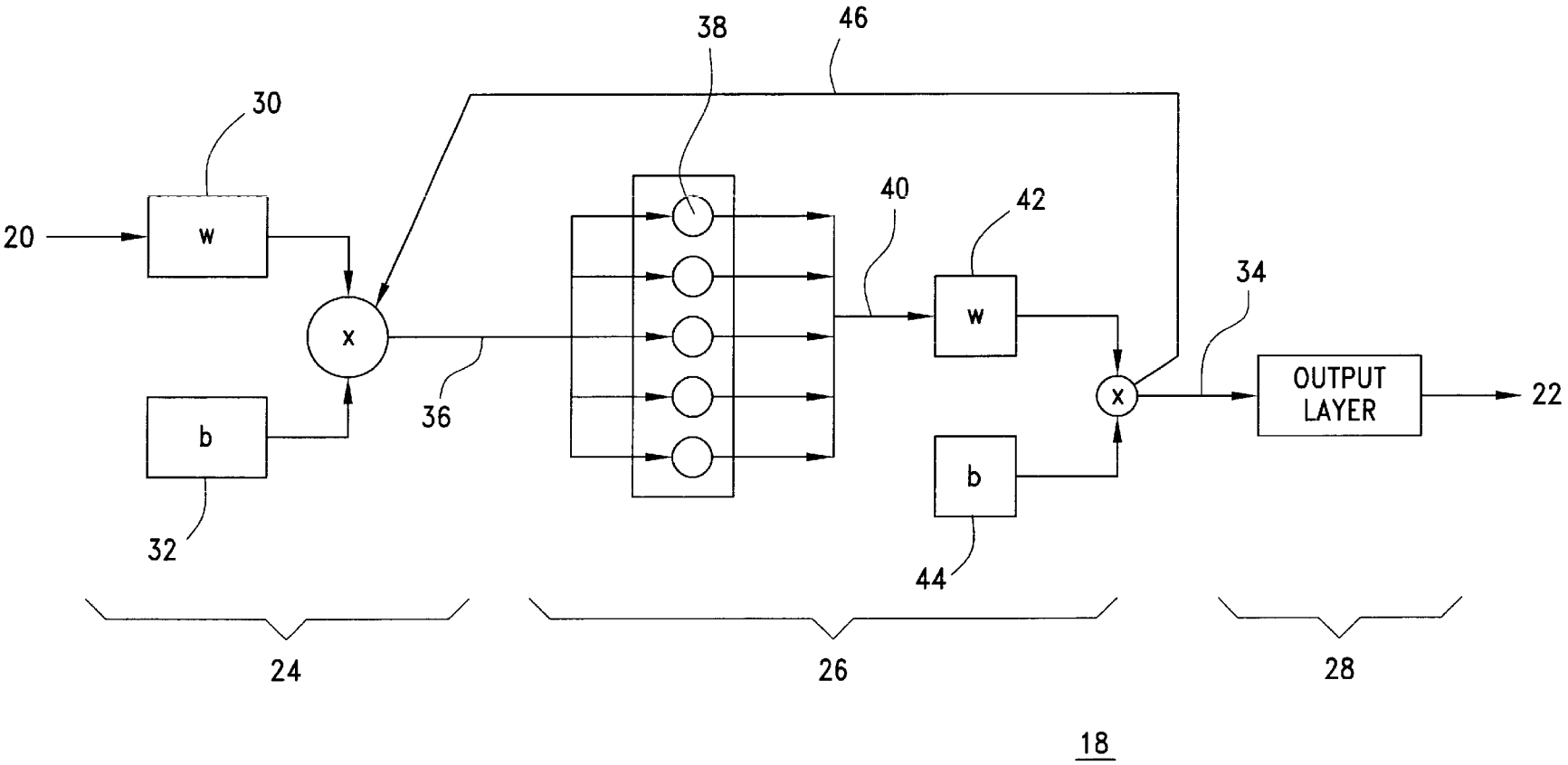
FIG. 3 is a schematic block diagram of a neural network that is employed in the system of FIG. 1.

FIG. 3 illustrates the details of the neural network 18. The neural network 18 takes a set of input values 20 from the frequency estimator 15 and computes a corresponding set of output estimate values 22. To do this, the neural network includes three layers, an input layer 24, a "hidden" layer 26 and an output layer 28. In the input layer 24, the input values 20 are multiplied by a first set of weights 30 and biases 32. In addition, the input values 20 are also multiplied by an output 34 from the hidden layer 26 which is fed back to constrain the amount of change that the hidden layer 26 can impose. The input layer 24 thereby generates a weighted output 36 that is fed as input to the hidden layer 26.

In order to train the neural network 18, the values of the first set of weights 30 are adjusted based on an error-correcting algorithm that compares the estimated output values 22 with the target ("rear") output values. Once the error between the estimated and target output values is minimized, the network weights 30 are set (i.e., held constant). This set of constant weight values represent a "trained" state of the network 18. In other words, the network 18 has "learned" the task at hand and is able to estimate an output value given a certain input value.

The "hidden" or recurrent layer 26 of the network 18 comprises a group of tan-sigmoidal (graphed as a hyperbolic tangent, or 'ojive function') units 38, that may be referred to as "neurons". The sigmoidal function is given as:

$$f(n) = \frac{1}{(1Ae^{Bn})}$$

The number of the tan-sigmoidal units 38 can be varied, and is equal to the total number of voices to be tracked, each of which forms a part of the output signal 36 from the input layer 24. The tan-sigmoidal functions are thus applied to each of the values that form the input layer output 36 to thereby generate an intermediate output 40 in the hidden layer 26. This intermediate output 40 is then subjected to multiplication by a second set of weights 42 and biases 44 in the hidden layer 26 to generate the hidden layer output 34. As discussed previously, the hidden layer 26 has a feedback connection 46 ("recurrent" connection) back to the input layer 24 so that the hidden layer output 34 can be combined with the input layer output 36. This recurrent structure provides some constraint on the amount of change allowed in the processing of the hidden layer 26 so that future values or outputs of the hidden layer 26 are dependent upon past AMDF values in time. The resulting neural network 18 is thus well-suited for time-series prediction.

The hidden layer output 34 is comprised of a plurality of signals, one for each voice frequency to be tracked. These signals are linearly combined in the output layer 28 to generate the estimated output values 22. The output layer 28 is comprised of as many neurons as voices to be tracked. So, for example, if 5 voices are to be tracked, the output layer 28 contains 5 neurons.

The neural network 18 is trained using a backpropogation learning method to minimize the mean squared error. The network is presented with several single-talker AMDF $F_0$ tracks (rising $F_0$ tracks, falling or decreasing $F_0$ tracks and rise/fall or fall/rise $F_0$ tracks). The output estimates of the network are compared to the AMDF $F_0$ estimates to measure the error present in the network estimates. The weights of the network are then adjusted to minimize the network error.

In practice, the error of the neural network 18 has been so small, that the neural network outputs 22 have been used directly for tracking. However, it is also possible to use the network outputs to assign the AMDF-estimated $F_0$'s to the correct voice. In other words, the frequency estimator 15 is accurate in identifying fundamental frequencies that are present in the waveform, but cannot track them through time. The outputs 22 from the neural network 18 provide this missing information so that the each voice track generated by the neural network 18 can be matched up with the correct fundamental frequency generated by the frequency estimator 15. This alternative arrangement is illustrated by the dashed lines inj FIG. 1.

Finally, the outputs 22 from the neural network 18, which represent the estimates of the trajectories for each voice, are then fed to any suitable type of utilization device 48. For example, the utilization device 48 can be a voice track storage unit to facilitate later analysis of the waveform, or may be a filtering system that can be used in real time to segregate the voices from one another.

Figure 4:
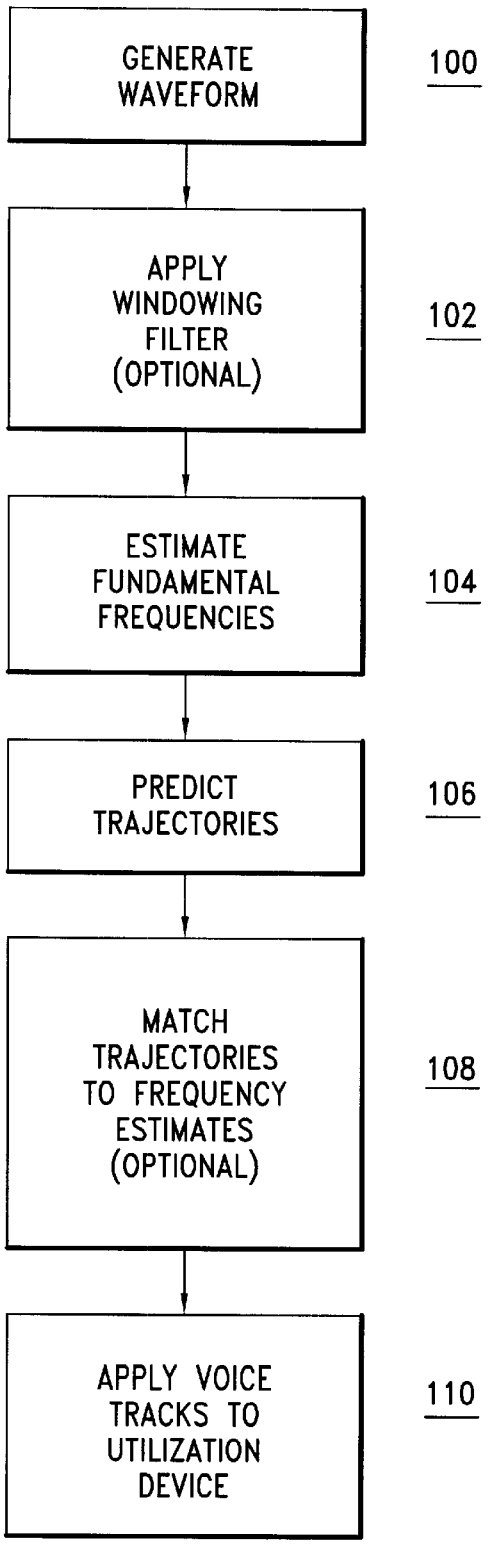
FIG. 4 is a flow chart illustrating the method steps carried out by the system of FIG. 1.

The foregoing method flow of the present invention is set forth in the flow chart of FIG. 4, and is summarized as follows. First, at step 100, the acoustic waveform is generated by the microphone 12. Next, at step 102, the waveform is filtered through the Kaiser window function to apply onset and offset ramps. As noted previously, this step is preferred, but can be omitted if desired. At step 104, the windowed waveform is submitted to the frequency estimator 15 to estimate the $F_0$ of each talker's voice that is present in the waveform. Next, at step 106, the estimated $F_0$ values are sent to the neural network 18 which predicts the next time value of the $F_0$ for each talker's $F_0$ track, and thereby generates tracks for each talker's voice. In optional step 108, these tracks can then be compared to the frequency estimates generated by the frequency estimator 15 for matching of the tracks to the frequency estimates. Finally, at step 110, the generated voice tracks are fed to the utilization device 48 for either real time use or subsequent analysis.

It should be noted that each of the elements of the invention, including the windowing filter 14, frequency estimator 15 and neural network 18, can be implemented either in hardware as illustrated in FIG. 1 (e.g., code on one or more DSP chips), or in a software program (e.g., C program). The former arrangement is preferred for applications where small size is an issue, such as in a hearing aid, while the software implementation is attractive for use, for example, in voice recognition applications for personal computers.

With specific reference to the aforementioned potential applications for the subject invention, for hearing-impaired listeners, the most common and most problematic communicative environment is one where several people are talking at the same time. With the recent development of fully digital hearing aids, this voice tracking scheme could be implemented so that the voice of the intended talker could be followed through time, while the speech sounds of the other competing talkers were removed. A practical approach to this would be to complete the spectrum of the mixture along with the AMDF and simply remove the voicing energy of the competing talkers.

Today, computer speech recognition systems work well with a single talker using a single microphone in a relatively quiet environment. However, in more realistic work environments, employees are often placed in work settings that are not closed to the intrusion of other voices (e.g., a large array of cubicles in an open-plan office). In this instance, the speech signals from adjacent talkers may interfere with the speech input of the primary talker into the computer recognition system. A valuable solution would be to employ the subject system and method to select the target talker's voice and follow it through time, separating it from other speech sounds that are present.

Although the present invention has been disclosed in terms of a preferred embodiment and variations thereon, it will be understood that numerous additional variations and modifications could be made thereto without departing from the scope of the invention as set forth in the following claims.

What is claimed is:

1. A system for tracking voices in a multiple voice environment, said system comprising:

a) a frequency estimator for receiving an acoustic waveform comprised of a plurality of voice components, each of which corresponds to a different individual's voice, and generating a plurality of estimates of fundamental frequencies in said waveform, each of said fundamental frequencies corresponding to one of said voice components; and b) a neural network for receiving said estimates of said fundamental frequencies from said frequency estimator, and generating an estimate of a trajectory of each of said fundamental frequencies as a function of time.

2. The system of claim 1, further comprising a windowing filter for receiving said waveform, generating a plurality of successive samples of said waveform, and supplying said samples to said frequency estimator.

3. The system of claim 2, wherein said windowing filter is a Kaiser windowing filter.

4. The system of claim 2, wherein said frequency estimator comprises means for calculating an average magnitude difference function for subtracting successive ones of said samples from one another to identify said fundamental frequencies in said waveform.

5. The system of claim 1, wherein said frequency estimator comprises means for calculating an average magnitude difference function for subtracting successive ones of a plurality of time shifted samples of said waveform from said waveform to identify said fundamental frequencies in said waveform.

6. The system of claim 1, wherein said neural network includes:

1) an input layer for applying a set of weights and biases to said fundamental frequency estimates to generate a plurality of weighted estimates;

2) a hidden layer having an input for receiving said weighted estimates and generating a plurality of hidden layer outputs; and 3) an output layer for linearly combining said hidden layer outputs and generating said trajectory estimates of each of said fundamental frequencies as a function of time.

7. The system of claim 6, wherein said hidden layer is further comprised of a plurality of tan-sigmoidal units.

8. The system of claim 6, wherein said neural network further includes a feedback connection between said hidden layer outputs and said input layer for supplying said hidden layer outputs as a weight to said frequency estimates.

9. The system of claim 1, further comprising:

c) a microphone for generating said acoustic waveform; and d) a utilization device for receiving said trajectory estimates from said neural network.

10. The system of claim 1, wherein said frequency estimator and said neural network are implemented in hardware.

11. The system of claim 1, wherein said frequency estimator and said neural network are implemented in software.

12. A system for tracking voices in a multiple voice environment, said system comprising:

a) a windowing filter for receiving an acoustic waveform comprised of a plurality of voice components, each of which corresponds to a different individual's voice, and generating a plurality of successive samples of said waveform;

b) a frequency estimator for receiving said samples and generating an estimate of a plurality of fundamental frequencies in said waveform at a given point in time, each of said fundamental frequencies corresponding to one of said voice components, said frequency estimator comprising means for calculating an average magnitude difference function for subtracting successive ones of said samples from one another to identify said fundamental frequencies in said waveform; and c) a neural network for receiving said estimates of said fundamental frequencies from said frequency estimator, and generating an estimate of a trajectory of each of said fumdamental frequencies as a function of time, said neural network comprising:

1) an input layer for receiving said fundamental frequencies from said frequency estimator and generating a plurality of weighted outputs;

2) a hidden layer comprising of a plurality of tan-sigmoidal units, said hidden layer having an input for receiving said weighted outputs and generating a plurality of hidden layer outputs, said hidden layer further including a feedback connection for supplying said hidden layer outputs back to said input layer for constraining the amount of change allowed in the processing of said hidden layer; and 3) an output layer for linearly combining said hidden layer outputs to generate said trajectory estimates of each of said fundamental frequencies as a function of time.

13. A method for identifying and tracking individual voices in an acoustic waveform comprised of a plurality of voices, said method comprising the steps of:

a) generating an acoustic waveform, said waveform comprised of a plurality of voice components, each of which corresponds to a different individual's voice;

b) generating estimates of a plurality of fundamental frequencies in said waveform, each of said fundamental frequencies corresponding to one of said voice components;

c) supplying said fundamental frequency estimates to a neural network; and d) generating with said neural network, an estimate of a trajectory of each of said fundamental frequencies as a function of time.

14. The method of claim 13, wherein steps b and c are periodically repeated so that said neural network can update said trajectory estimates.

15. The method of claim 13, wherein said step of generating estimates of a plurality of fundamental frequencies in said waveform comprises:

1) applying said waveform to a windowing filter to generate a plurality of successive samples of said waveform; and 2) applying an average magnitude difference function to successive ones of said samples to identify and generate said estimates of said fundamental frequencies in said waveform.

16. The method of claim 15, wherein said windowing filter is a Kaiser windowing filter.

17. The method of claim 13, wherein said step of generating with said neural network, an estimate of a trajectory of each of said fundamental frequencies as a function of time, comprises:

1) applying weights and biases to said frequency estimates to generate a plurality of weighted frequency estimates;

2) applying said weighted frequency estimates to a plurality of tan-sigmoidal units, one for each of said estimates, to generate a plurality of corresponding outputs; and 3) linearly combining said plurality of outputs to generate said trajectory estimates.

18. The method of claim 17, wherein said step of applying weights and biases further comprises applying said plurality of outputs from said tan-sigmoidal units as feedback to said frequency estimates.

19. The method of claim 13, further comprising the step of matching said trajectory estimates with said frequency estimates.

20. The method of claim 13, further comprising the step of applying said trajectory estimates to a voice separation device.

* * * * *